US005535550A

United States Patent [19]

Yang

[11] Patent Number: 5,535,550

[45] Date of Patent: Jul. 16, 1996

[54] DOOR STRUCTURE

[75] Inventor: Chen-kuo Yang, Yunlin Hsien, Taiwan

[73] Assignee: Yueh-Der Metal Ind. Co., Ltd., Taipei, Taiwan

[21] Appl. No.: 488,608

[22] Filed: Jun. 8, 1995

[51] Int. Cl.[6] ..... E05F 11/52

[52] U.S. Cl. ..... 49/163; 292/92; 49/169; 49/171; 49/192

[58] Field of Search ..... 49/61, 63, 65, 49/67, 163, 169, 171, 192; 70/92; 292/92

[56] References Cited

U.S. PATENT DOCUMENTS

| | | | |
|---|---|---|---|
| 1,100,546 | 6/1914 | Heryford | 49/169 |
| 1,859,974 | 5/1932 | Kroenke | 49/169 |
| 4,785,286 | 11/1988 | Martin | 292/92 |
| 5,085,475 | 2/1992 | Austin et al. | 292/92 |
| 5,253,905 | 10/1993 | Hutson | 292/92 |

*Primary Examiner*—Brian K. Green

*Assistant Examiner*—Curtis A. Cohen

*Attorney, Agent, or Firm*—Abelman, Frayne & Schwab

[57] ABSTRACT

A door structure includes a main door having an opening defined therein. A first and second auxiliary doors are hingedly fitted in the opening. A first and second latches are movably mounted on one end portion of the first and second auxiliary doors and are detachably engaged in a first and second notches defined in the main door. A first and second transmission mechanisms are respectively mounted in the first and second auxiliary doors for controlling the first and second latches to be detachably engaged in the first and second notches. A first and second driving members are respectively mounted in the first and second auxiliary doors for driving the first and second transmission mechanisms. A linking rod is connected between the first and second driving members such that the first and second driving members are able to operate synchronously so as to detach the first and second latches from the first and second notches synchronously via the first and second transmission mechanisms respectively.

3 Claims, 5 Drawing Sheets

DOOR STRUCTURE

BACKGROUND OF THE INVENTION

1. Field of the Invention

The present invention relates to a door structure, and more particularly to a single door structure functioning as a two-door combination.

2. Related Prior Art

A conventional door structure is fitted in a door frame of a house and includes a latch to be locked in a recess defined in the door frame. By such an arrangement, a user has to open the door by means of keys to detach the latch from the door frame. If the user has to open the door immediately to go outdoors when emergency conditions such as fire accident, earthquake or the like happen, he/she may not have enough time to find out key to detach the latch from the door frame to open the door, so easily incurring a damage when in emergency.

The present invention has arisen to mitigate and/or obviate the disadvantages of the conventional door structure.

SUMMARY OF THE INVENTION

The primary objective of the present invention is to provide a door structure which is easily opened and closed.

In accordance with one aspect of the present invention, there is provided a door structure comprising a main door including a first end portion and a second end portion each having a first side and a second side. An opening is defined in the main door between the first and second end portions thereof. A first notch and a second notch are respectively defined in the first and second sides of the second end portion of the main door.

A first auxiliary door is hingedly fitted in the opening between the first side of the first and second end portions of the main door and includes a first end potion and a second end portion. A first latch is movably mounted on the second end portion of the first auxiliary door and is detachably engaged in the first notch. A first transmission mechanism is mounted in the second end portion of the first auxiliary door for controlling the first latch to be detachably engaged in the first notch. A first driving member is mounted in a mediate portion of the first auxiliary door for driving the first transmission mechanism.

A second auxiliary door is hingedly fitted in the opening between the second side of the first and second end portions of the main door and includes a first end potion and a second end portion. A second latch is movably mounted on the second end portion of the second auxiliary door and is detachably engaged in the second notch. A second transmission mechanism is mounted in the second end portion of the second auxiliary door for controlling the second latch to be detachably engaged in the second notch. A second driving member is mounted on a mediate portion of the second auxiliary door for driving the second transmission mechanism.

A linking rod is connected between the first and second driving members such that the first and second driving members are able to operate synchronously so as to detach the first and second latches from the first and second notches synchronously via the first and second transmission mechanisms respectively.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
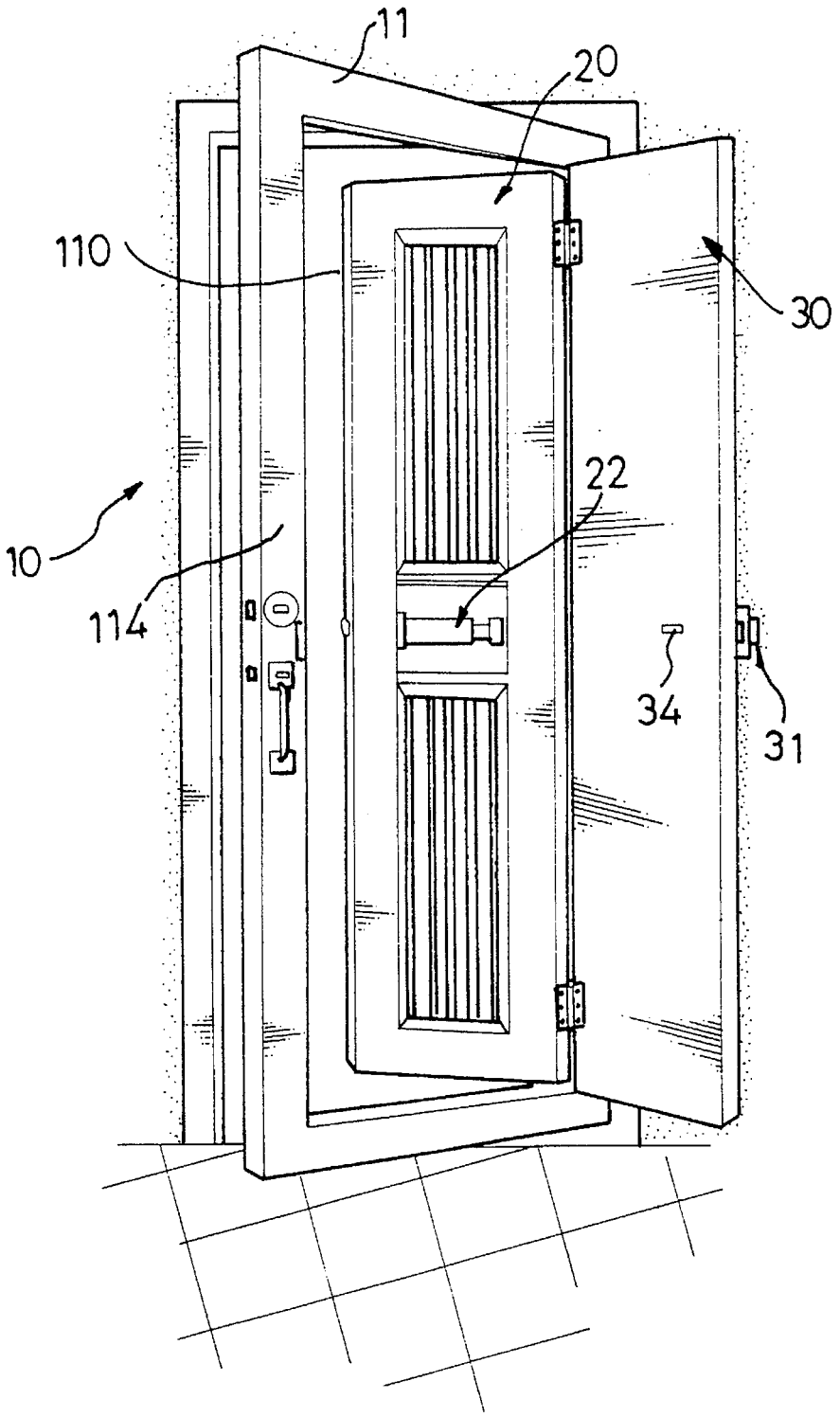
FIG. 1 is a perspective view of a door structure in accordance with the present invention.
Figure 2:
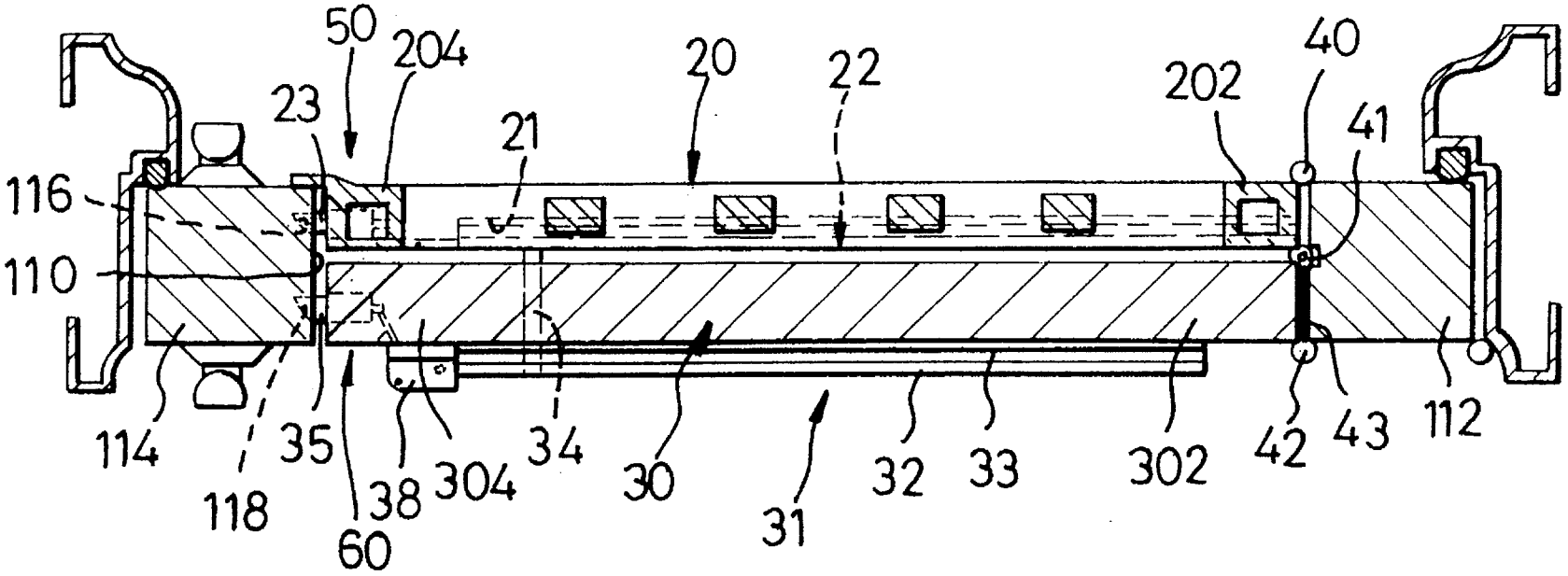
FIG. 2 is a top plan cross-sectional view of the door structure.

Referring to the drawings and initially to FIGS. 1 and 2, a door structure 10 in accordance with the present invention comprises a main door 11 including a first end portion 112 and a second end portion 114 each having a first side and a second side. An opening 110 is defined in the main door 11 between the first and second end portions 112 and 114 thereof. A first notch 116 and a second notch 118 are respectively defined in the first and second sides of the second end portion 114 of the main door 11.

A first auxiliary door 20 is hingedly fitted in the opening 110 between the first side of the first and second end portions 112 and 114 of the main door 11 and includes a first end potion 202 hingedly engaged with a hinge member 40 and a second end portion 204 abutting on the first side of the second end portion 114 of the main door 11. A first latch 23 is movably mounted on the second end portion 204 of the first auxiliary door 20 and is detachably engaged in the first notch 116.

A first transmission mechanism 50 is mounted in the second end portion 204 of the first auxiliary door 20 for controlling the first latch 23 to be detachably engaged in the first notch 116. A first driving member 22 is mounted in a mediate portion of the first auxiliary door 20 for driving the first transmission mechanism 50. Preferably, the first driving member 22 is mounted in a recess 21 defined in the mediate portion of the first auxiliary door 20.

A second auxiliary door 30 is hingedly fitted in the opening 110 between the second side of the first and second end portions 112 and 114 of the main door 11 and includes a first end potion 302 hingedly connected with a hinge member 42 and a second end portion 304 adjacent the second side of the second end portion 114 of the main door 11. A second latch 35 is movably mounted on the second end portion 304 of the second auxiliary door 30 and is detachably engaged in the second notch 118.

A second transmission mechanism 60 is mounted in the second end portion 304 of the second auxiliary door 30 for controlling the second latch 35 to be detachably engaged in the second notch 118. A second driving member 31 is mounted on a mediate portion of the second auxiliary door 30 for driving the second transmission mechanism 60.

A linking rod 34 has a first end 342 connected with the first driving member 22 and a second end 344 connected with the second driving member 31 such that the first and second driving members 22 and 31 are able to operate synchronously so as to detach the first and second latches 23 and 35 from the first and second notches 116 and 118 synchronously via the first and second transmission mechanisms 50 and 60 respectively.

Figure 4:
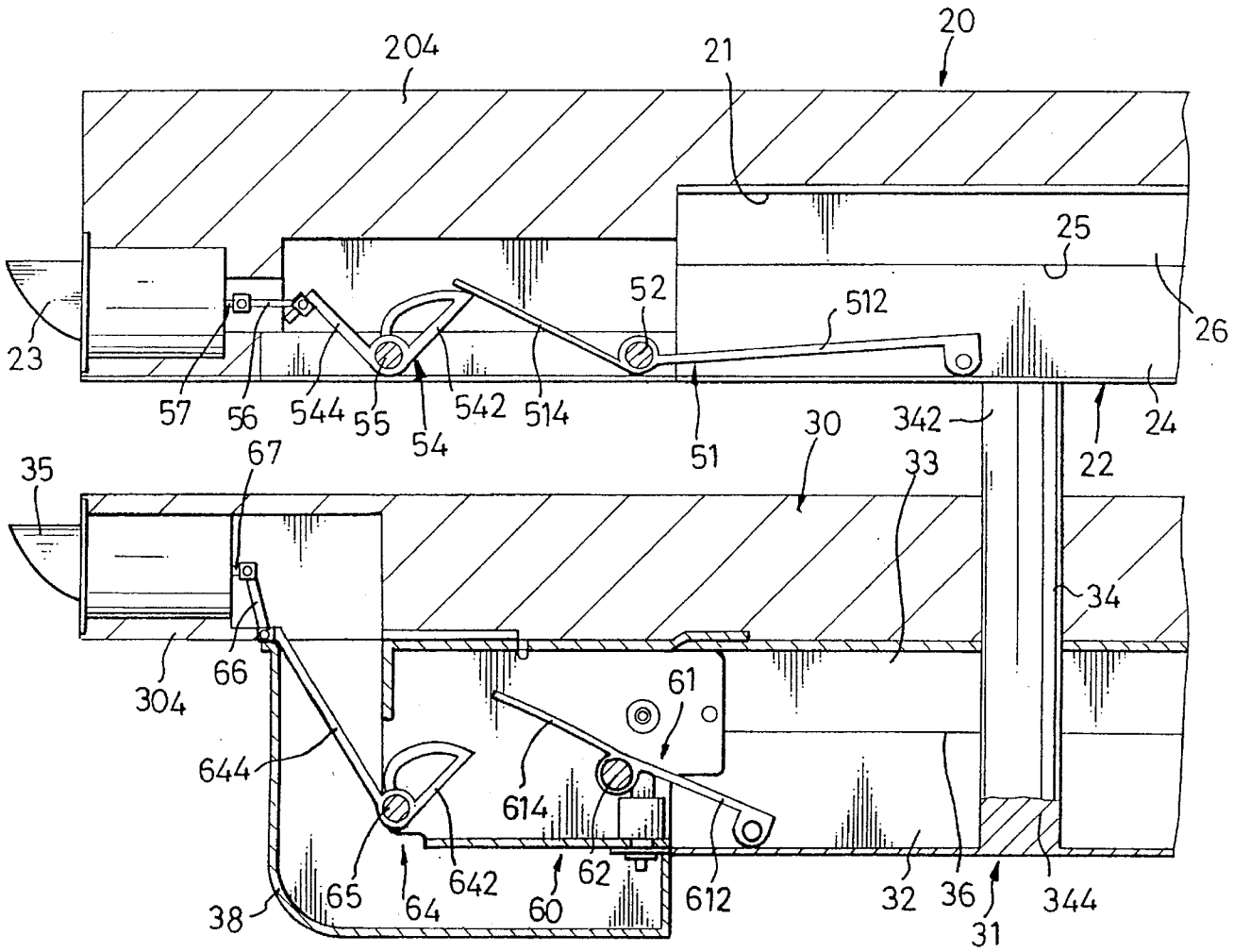
FIG. 4 is an partially enlarged top plan view of the door structure.

Referring to FIGS. 2 and 4, the first driving member 22 includes an elongated snapping element 26 fixedly mounted in the mediate portion of the first auxiliary door 20. An elongated pressing element 24 is movably mounted on the snapping element 26 and is driven by means of the linking rod 34 to displace relative to the snapping element 26. A space 25 is defined between the pressing element 24 and the snapping element 26.

The first transmission mechanism 50 comprises two pivot axles 52 and 55 fixedly mounted in the second end portion 204 of the first auxiliary door 20. An included lever 51 is pivotally mounted on the pivot axle 52 and includes a first arm 512 received in the space 25 and urged on the pressing element 24 and a second arm 514 urged on a first portion 542 of a substantially V-shaped pawl member 54 which is pivotally mounted on the pivot axle 55 with a second portion 544 thereof pivotally engaged with a first end of a resilient strip 56 which includes a second end pivotally engaged with a first end of a shaft 57 which has a second end connected with the first latch 23.

The second driving member 31 includes an elongated snapping element 33 fixedly mounted in the mediate portion of the second auxiliary door 30. An elongated pressing element 32 is movably mounted on the snapping element 33 and is urged on the second end 344 of the linking rod 34 for driving the linking rod 34 to press the pressing element 24 of the first driving member 22. A space 36 is defined between the pressing element 32 and the snapping element 33.

The second transmission mechanism 60 comprises two pivot axles 62 and 65 fixedly mounted on the second end portion 304 of the second auxiliary door 30. A lever 61 is pivotally mounted on the pivot axle 62 and includes a first arm 612 received in the space 36 and urged on the pressing element 32 and a second arm 614 which is spaced from a distance to be detachably urged on a short portion 642 of a substantially V-shaped pawl member 64 which is pivotally mounted on the pivot axle 65 with a long portion 644 thereof pivotally engaged with a first end of a resilient strip 66 which includes a second end pivotally engaged with a first end of a shaft 67 which has a second end connected with the second latch 35.

Preferably, a housing 38 is attached to the second end portion 304 of the second auxiliary door 30 located adjacent the second driving member 31 for receiving the second transmission mechanism 60 therein.

Figure 3:
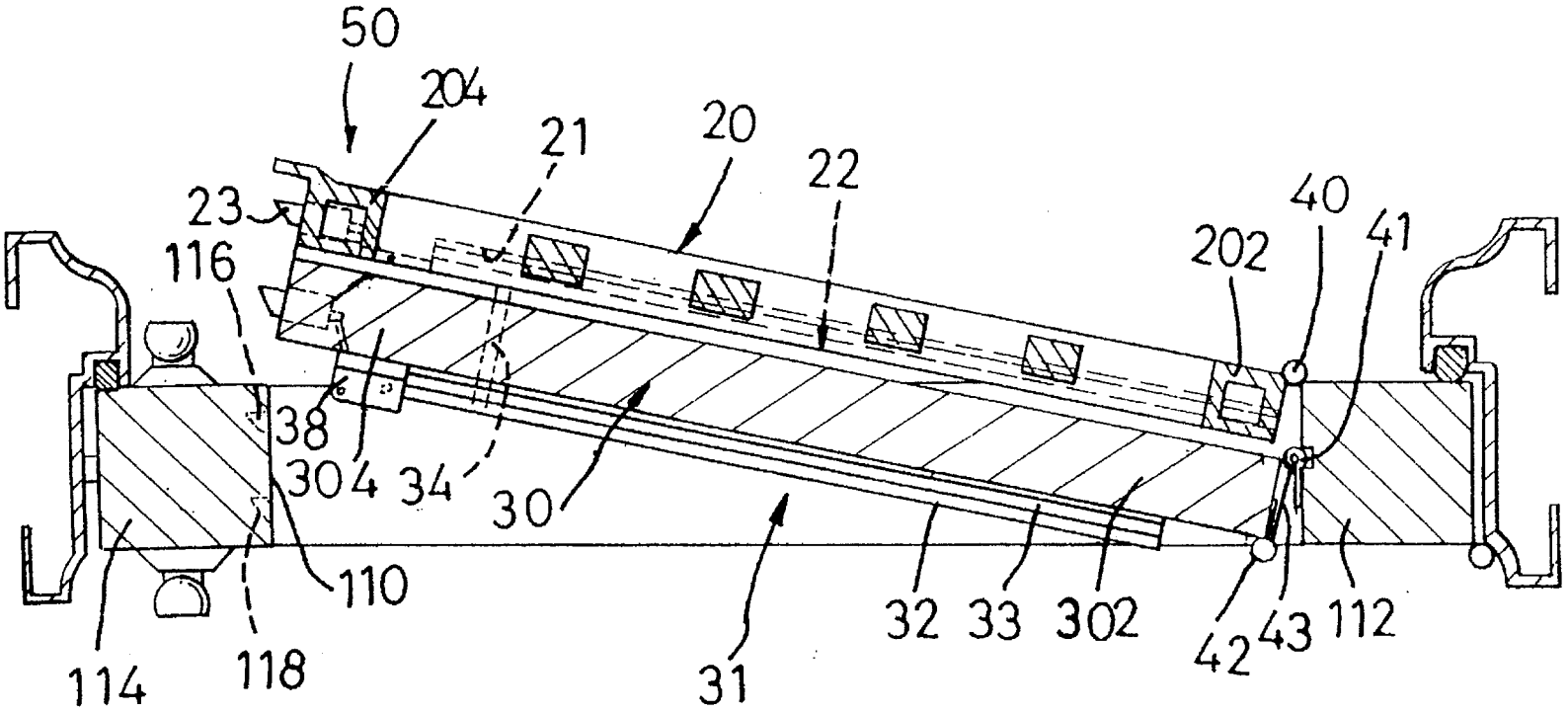
FIG. 3 is a top plan cross-sectional operational view of the door structure.
Figure 5:
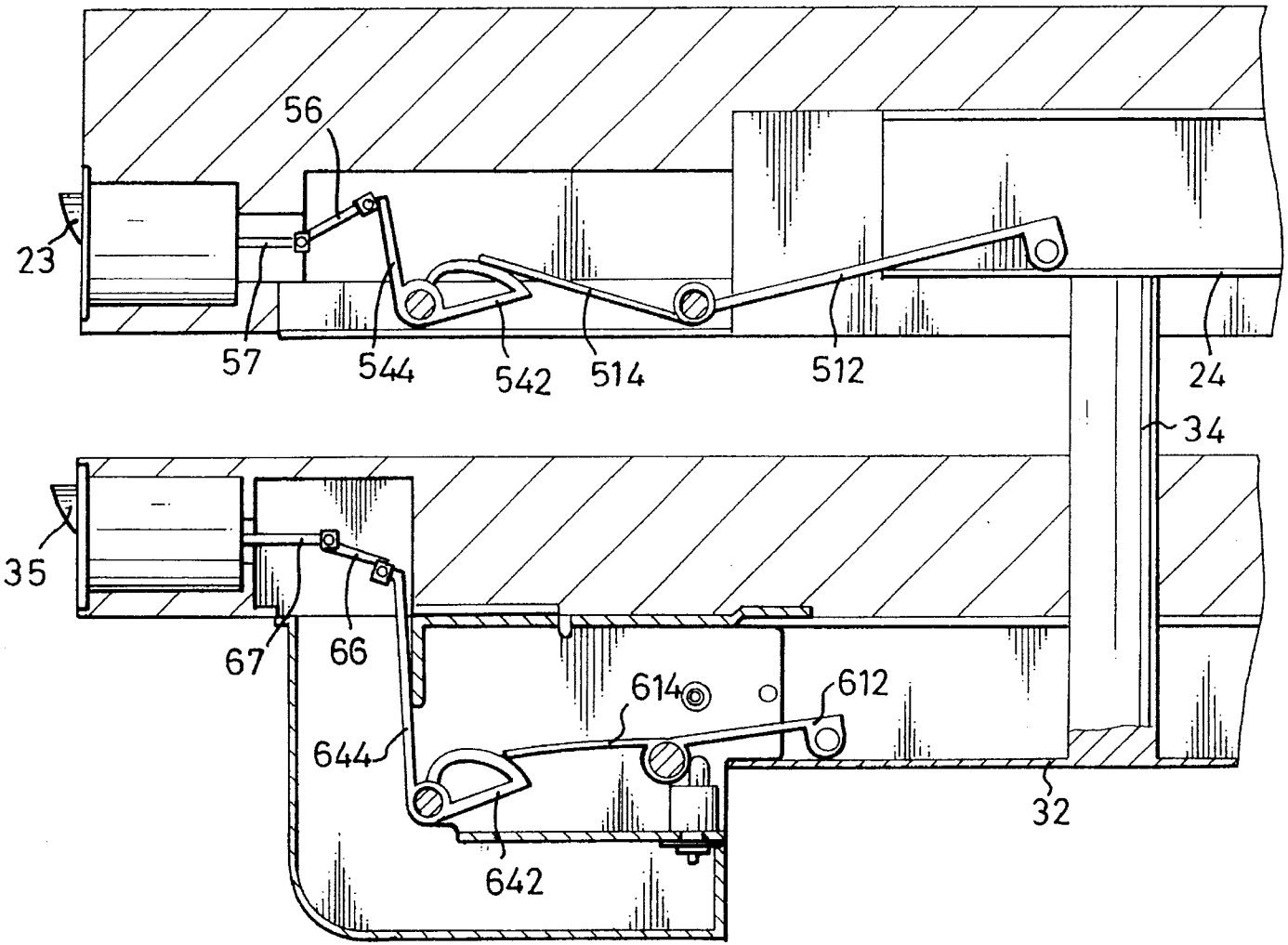
FIG. 5 is an partially enlarged top plan operational view of the door structure.

In operation, referring to FIGS. 4 and 5 with reference to FIGS. 2 and 3, a user can press the pressing element 32 of the driving member 31 to urge on the arm 612 of the lever 61 and synchronously urge on the linking rod 34 so as to force the pressing element 24 of the driving member 22 to urge on the arm 512 of the included lever 52.

Then, the levers 61 and 51 are pivoted about the pivot axles 62 and 52 with the arms 614 and 514 thereof respectively urged on the first portions 642 and 542 of the pawl members 64 and 54, thereby pivoting the pawl members 64 and 54 about the pivot axles 65 and 55 so as to rotate the second portions 644 and 544 thereof, thereby respectively pivoting the resilient strips 66 and 56 so as to detach the latches 35 and 23 from the notches 118 and 116 via the shafts 67 and 57, thereby releasing the first and second auxiliary doors 20 and 30 from the main door 11 as shown in FIG. 3.

It is to be noted that, referring to FIGS. 2 and 3, the first auxiliary door 20 is able to pivot about the hinge member 40 relative to the second auxiliary door 30 which is able to pivot about the hinge member 42 which is detachably engaged on the first end portion 112 of the main door 11. A hinge member 41 is mounted on the first end portion 112 of the main door 11 between the hinge members 40 and 42. A linking strip 43 is connected between the hinge members 41 and 42 such that when the first and second auxiliary doors 20 and 30 are opened and pivoted synchronously, the second auxiliary door 30 is able to pivot about the hinge member 41.

By such an arrangement, the user can open the first and second auxiliary doors 20 and 30 synchronously simply by means of exerting a pressing force on the pressing element 32 without the need to open the first and second auxiliary doors 20 and 30 separately and without the need to open the main door 11, so facilitating opening of the door structure 10 if the user has to open the door structure 10 immediately when in emergency.

Preferably, returning mechanisms (not shown) are respectively mounted in the driving members 22 and 31 for stretching between the pressing element 24 and the associated snapping element 26 and stretching between the pressing element 32 and the associated snapping element 33. In addition, returning mechanisms are also mounted in the levers 51 and 61 and mounted in the pawl members 54 and 64 for returning operation thereof.

It should be clear to those skilled in the art that further embodiments of the present invention may be made without departing from the teachings of the present invention.

What is claimed is:

1. A door structure (10) comprising:

a main door (11) including a first end portion (112) and a second end portion (114) each having a first side and a second side, an opening (110) being defined in said main door (11) between the first and second end portions (112 and 114) thereof, a first notch (116) and a second notch (118) respectively defined in the first and second sides of the second end portion (114) of said main door (11);

a first auxiliary door (20) hingedly fitted in said opening (110) between the first side of said first and second end portions (112 and 114) of said main door (11) and including a first end potion (202) and a second end portion (204), a first latch (23) movably mounted on the second end portion (204) of said first auxiliary door (20) and detachably engaged in said first notch (116);

a first transmission mechanism (50) mounted in the second end portion (204) of said first auxiliary door (20) for controlling said first latch (23) to be detachably engaged in said first notch (116);

a first driving member (22) mounted in a mediate portion of said first auxiliary door (20) for driving said first transmission mechanism (50);

a second auxiliary door (30) hingedly fitted in said opening (110) between the second side of said first and second end portions (112 and 114) of said main door (11) and including a first end portion (302) and a second end portion (304), a second latch (35) movably mounted on the second end portion (304) of said second auxiliary door (30) and detachably engaged in said second notch (118);

a second transmission mechanism (60) mounted in the second end portion (304) of said second auxiliary door (30) for controlling said second latch (35) to be detachably engaged in said second notch (118);

a second driving member (31) mounted on a mediate portion of said second auxiliary door (30) for driving said second transmission mechanism (60); and a linking rod (34) connecting between said first and second driving members (22 and 31) such that said first and second driving members (22) and (31) are able to operate synchronously so as to detach said first and second latches (23 and 35) from said first and second notches (116 and 118) synchronously via said first and second transmission mechanisms (50 and 60) respectively.

2. The door structure in accordance with claim 1, wherein said first driving member (22) includes a snapping element (26) fixedly mounted in the mediate portion of said first auxiliary door (20), a pressing element (24) movably mounted on said snapping element (26) and driven by means of said linking rod (34) to displace relative to said snapping element (26), a space (25) defined between said pressing element (24) and said snapping element (26), and wherein said first transmission mechanism (50) comprises a first pivot axle (52) and a second pivot axle (55) fixedly mounted in the second end portion (204) of said first auxiliary door (20), an included lever (51) pivotally mounted on said first pivot axle (52) and having a first arm (512) received in said space (25) and urged on said pressing element (24) and a second arm (514), a substantially V-shaped pawl member (54) pivotally mounted on said second pivot axle (55) and including a first portion (542) urged on the second arm (514) of said included lever (51) and a second portion (544), a resilient strip (56) having a first end pivotally engaged with the second portion (544) of said pawl member (54) and a second end, a shaft (57) having a first end pivotally engaged with the second end of said resilient strip (56) and a second end connected with said first latch (23).

3. The door structure in accordance with claim 1, wherein said second driving member (31) includes a snapping element (33) fixedly mounted on the mediate portion of said second auxiliary door (30), a pressing element (32) movably mounted on said snapping element (33) and connected with said linking rod (34) for driving said linking rod (34) to control an operation of said first driving member (22), a space (36) defined between said pressing element (32) and said snapping element (33), and wherein said second transmission mechanism (60) comprises a first pivot axle (62) and a second pivot axle (55) fixedly mounted on the second end portion (304) of said second auxiliary door (30), a lever (61) pivotally mounted on said first pivot axle (62) and having a first arm (612) received in said space (36) and urged on said pressing element (32) and a second arm (614), a substantially V-shaped pawl member (64) pivotally mounted on said second pivot axle (65) and including a short portion (642) able to be detachably urged on the second arm (614) of said lever (61) and a long portion (644), a resilient strip (66) having a first end pivotally engaged with the long portion (644) of said pawl member (64) and a second end, a shaft (67) having a first end pivotally engaged with the second end of said resilient strip (66) and a second end connected with said second latch (35).

* * * * *